US008589004B1

(12) United States Patent
Kanno

(10) Patent No.: US 8,589,004 B1
(45) Date of Patent: Nov. 19, 2013

(54) BOAT PROPULSION SYSTEM AND METHOD FOR CONTROLLING BOAT PROPULSION SYSTEM

(71) Applicant: Yamaha Hatsudoki Kabushiki Kaisha, Iwata (JP)

(72) Inventor: Isao Kanno, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 0 days.

(21) Appl. No.: 13/795,775

(22) Filed: Mar. 12, 2013

(30) Foreign Application Priority Data

Oct. 2, 2012 (JP) ..... 2012-220665

(51) Int. Cl.
*G05D 1/00* (2006.01)
*B63H 25/00* (2006.01)

(52) U.S. Cl.
USPC ..... 701/21; 440/4

(58) Field of Classification Search
USPC ..... 701/1, 21; 440/4, 49, 53
See application file for complete search history.

(56) References Cited

U.S. PATENT DOCUMENTS 5,591,057 A * 1/1997 Dai et al. ..... 440/42
6,994,046 B2 * 2/2006 Kaji et al. ..... 114/144 R
7,052,341 B2 * 5/2006 Kaji et al. ..... 440/75
7,320,629 B2 * 1/2008 Okuyama ..... 440/53
7,389,735 B2 * 6/2008 Kaji et al. ..... 114/144 RE
7,438,013 B2 * 10/2008 Mizutani ..... 114/144 RE
8,234,024 B2 * 7/2012 Nose et al. ..... 701/21
8,428,801 B1 * 4/2013 Nose et al. ..... 701/21
2005/0263058 A1 12/2005 Suemori et al.
2007/0017426 A1 * 1/2007 Kaji et al. ..... 114/144 RE
2011/0166724 A1 * 7/2011 Hiramatsu ..... 701/21

FOREIGN PATENT DOCUMENTS

EP 0778196 A1 6/1997
JP 09-156596 A 6/1997
JP 2005-319967 A 11/2005

* cited by examiner

*Primary Examiner* — Russell Frejd
(74) *Attorney, Agent, or Firm* — Keating & Bennett, LLP

(57) ABSTRACT

A control unit for a boat propulsion system individually controls the forward and reverse propulsion directions, the propulsion force, and the steering angle of each of a plurality of boat propulsion units so that a point of action of a first resultant force is positioned behind a point of action of a second resultant force when the control unit receives an operational command from an operation device for travel in a lateral direction of a hull. The first resultant force is a resultant force of propulsion forces generated by the first port-side propulsion unit and the first starboard-side propulsion unit. The second resultant force is a resultant force of propulsion forces generated by the second port-side propulsion unit and the second starboard-side propulsion unit.

13 Claims, 10 Drawing Sheets

BOAT PROPULSION SYSTEM AND METHOD FOR CONTROLLING BOAT PROPULSION SYSTEM

BACKGROUND OF THE INVENTION

1. Field of the Invention

The present invention relates to a boat propulsion system and a method for controlling a boat propulsion system.

2. Description of the Related Art

There are boats equipped with a plurality of boat propulsion units in order to improve high-speed performance, turning performance, steering stability, and other boat performance factors. An operation device capable of outputting operational commands at least in the directions of forward, reverse, left, and right is equipped in the boat in order to facilitate, even for a user without skill in operating a boat, operation of a boat provided with a plurality of boat propulsion units.

For example, Japanese Laid-open Patent Application No. 2005-319967 discloses a boat in which two propulsion units are operated by a joystick. In this boat, two propulsion units are controlled so that the boat is moved laterally or rotated based on the operational command provided by joystick.

Japanese Laid-open Patent Application No. 09-156596 discloses a boat equipped with four propulsion units. In this boat, the inside two of the four propulsion units are controlled so that the boat is moved or rotated based on the operational command provided by the joystick. However, the outside two propulsion units are auxiliary propulsion units and are not steered.

The following problems arise when the control in the two-engine boat of Japanese Laid-open Patent Application No. 2005-319967 is applied without modification to a four-engine boat when the boat is made to move laterally on the basis of an operational command provided by an operation device in a boat equipped with four propulsion units. In order to cause a boat 100 to move laterally, the intersection of the lines of action of the propulsion forces generated by four propulsion units 101 to 104 must all match a resistance center RC, as shown in FIG. 10. However, since there is a limit to the steering angle of the propulsion units, there are cases in which the outside propulsion units 101 and 104 cannot be adequately steered such that lines of action L101 and L104 pass through the resistance center RC.

Thus, it is possible to steer only the two inside propulsion units to move laterally, as shown in Japanese Laid-open Patent Application No. 09-156596. However, in this case, sufficient propulsion forces cannot be generated for a relatively large boat equipped with four propulsion units, because the propulsion forces in the lateral direction are low.

SUMMARY OF THE INVENTION

In order to overcome the problems described above, preferred embodiments of the present invention provide a boat propulsion system and a method for controlling a boat propulsion system such that a boat can be effectively made to move laterally on the basis of an operational command provided by an operation device in a boat equipped with at least four propulsion units.

The boat propulsion system according to a first preferred embodiment of the present invention includes a plurality of boat propulsion units, an operation device, and a control unit. The plurality of boat propulsion units include a first port-side propulsion unit, a second port-side propulsion unit, a first starboard-side propulsion unit, and a second starboard-side propulsion unit. The first port-side propulsion unit is disposed to the left of a center line extending in the longitudinal direction of a hull of the boat. The second port-side propulsion unit is disposed to the left of the first port-side propulsion unit. The first starboard-side propulsion unit is disposed to the right of the center line. The second starboard-side propulsion unit is disposed to the right of the first starboard-side propulsion unit. The plurality of boat propulsion units are configured so as to be capable of switching between forward and reverse travel directions independently from each other. The plurality of boat propulsion units are configured so as to be capable of being steered independently from each other. The operation device is configured so as to be capable of outputting operational commands in at least the directions of forward, reverse, left, and right. The control unit individually controls the forward and reverse propulsion directions, the propulsion force, and the steering angle of each of the plurality of boat propulsion units so that a point of action of a first resultant force is positioned behind a point of action of a second resultant force when the control unit receives an operational command from the operation device to travel in the lateral direction. The first resultant force is a resultant force of propulsion forces generated by the first port-side propulsion unit and the first starboard-side propulsion unit. The second resultant force is a resultant force of propulsion forces generated by the second port-side propulsion unit and the second starboard-side propulsion unit.

A method for controlling a boat propulsion system according to a second preferred embodiment of the present invention includes controlling a plurality of boat propulsion units. The plurality of boat propulsion units include a first port-side propulsion unit, a second port-side propulsion unit, a first starboard-side propulsion unit, and a second starboard-side propulsion unit. The first port-side propulsion unit is disposed to the left of a center line extending in the longitudinal direction of a hull of the boat. The second port-side propulsion unit is disposed to the left of the first port-side propulsion unit. The first starboard-side propulsion unit is disposed to the right of the center line. The second starboard-side propulsion unit is disposed to the right of the first starboard-side propulsion unit. The plurality of boat propulsion units are configured so as to be capable of switching between forward and reverse travel directions independently from each other. The plurality of boat propulsion units are configured so as to be capable of being steered independently from each other. The method for controlling the boat propulsion system preferably includes the following steps. In the first step, operational commands are received from an operation device capable of outputting operational commands to travel at least in the directions of forward, reverse, left, and right. In the second step, the forward and reverse propulsion directions, the propulsion force, and the steering angle of each of the plurality of boat propulsion units are individually controlled so that a point of action of a first resultant force is positioned behind a point of action of a second resultant force when an operational command from the operation device to travel in the lateral direction is received. The first resultant force is a resultant force of propulsion forces generated by the first port-side propulsion unit and the first starboard-side propulsion unit. The second resultant force is a resultant force of propulsion forces generated by the second port-side propulsion unit and the second starboard-side propulsion unit.

In a preferred embodiment of the present invention, the plurality of boat propulsion units are controlled so that the point of action of the first resultant force is positioned behind the point of action of the second resultant force when an operational command from the operation device to travel in the lateral direction is received. The first resultant force is the resultant force of propulsion forces generated by the first port-side propulsion unit and the first starboard-side propulsion unit. In other words, the first resultant force is a resultant force of the propulsion forces generated by the inside two propulsion units. The second resultant force is a resultant force of propulsion forces generated by the second port-side propulsion unit and the second starboard-side propulsion unit. In other words, the second resultant force is the resultant force of the propulsion forces generated by the outside two propulsion units. Therefore, the hull moves laterally because of the balance between the resultant force of the inside two propulsion units and the resultant force of the outside two propulsion units. In this case, the steering angle of the outside two propulsion units can be reduced because the point of action of the second resultant force is positioned in front of the point of action of the first resultant force. Also, a sufficient propulsion force can be obtained because the hull moves due to the resultant forces of the four propulsion units. In this way, a boat according to preferred embodiments of the present invention can be effectively made to move laterally on the basis of an operational command provided by an operation device.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
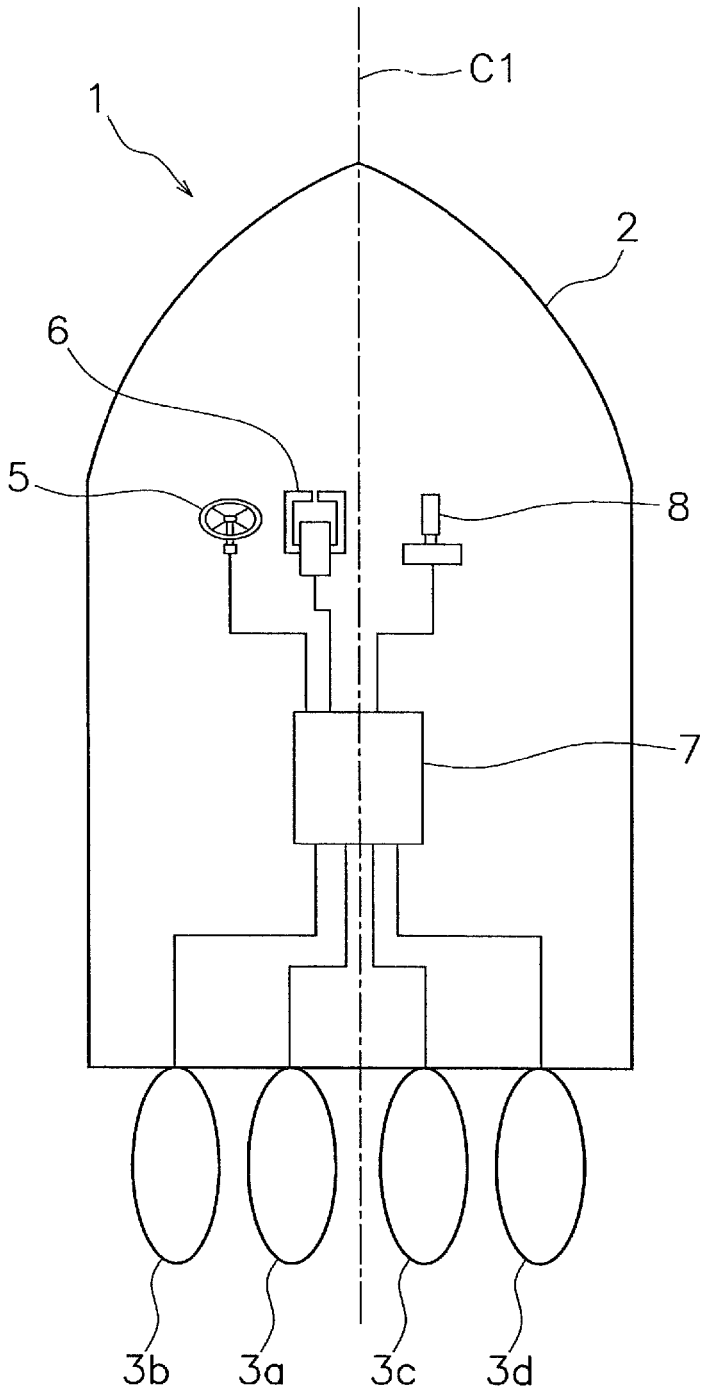
FIG. 1 is a schematic view of a boat equipped with a boat propulsion system according to a preferred embodiment of the present invention.

Preferred embodiments of the present invention are described below with reference to the drawings. FIG. 1 is a schematic view showing a boat 1. The boat 1 is equipped with a boat propulsion system according to a preferred embodiment of the present invention. The boat 1 includes a hull 2 and a plurality of boat propulsion units 3*a* to 3*d*, as shown in FIG. 1. The boat propulsion units 3*a* to 3*d* are preferably outboard engines. Specifically, the boat 1 is provided with a first port-side propulsion unit 3*a* (hereinafter referred to as "first port unit 3*a*"), a second port-side propulsion unit 3*b* (hereinafter referred to as "second port unit 3*b*"), a first starboard-side propulsion unit 3*c* (hereinafter referred to as "first starboard unit 3*c*"), and a second starboard-side propulsion unit 3*d* (hereinafter referred to as "second starboard unit 3*d*").

The boat propulsion units 3*a* to 3*d* are mounted on the stern of the hull 2. The boat propulsion units 3*a* to 3*d* are disposed in a line in the width or lateral direction of the hull 2. Specifically, the first port unit 3*a* is disposed to the left of a center line C1 extending in the longitudinal direction of the hull 2. The second port unit 3*b* is disposed to the left of the first port unit 3*a*. The first starboard unit 3*c* is disposed to the right of the center line C1. The second starboard unit 3*d* is disposed to the right of the first starboard unit 3*c*. The boat propulsion units 3*a* to 3*d* generate propulsion forces to propel the boat 1.

A steering device 5, a remote control device 6, a direction operation device 8, and a controller 7 are disposed in a control compartment of the hull 2. The steering device 5 is used by the operator to turn the direction of the boat 1. The remote control device 6 is used by the operator to adjust the boat speed. The direction operation device 8 is used by the operator to operate the movement direction of the boat in at least the forward, reverse, left, and right directions. The remote control device 6 is used by the operator to switch the boat 1 between forward travel and reverse travel directions. The controller 7 is programmed to control the propulsion units in accordance with operation signals from the steering device 5 and the remote control device 6.

Figure 2:
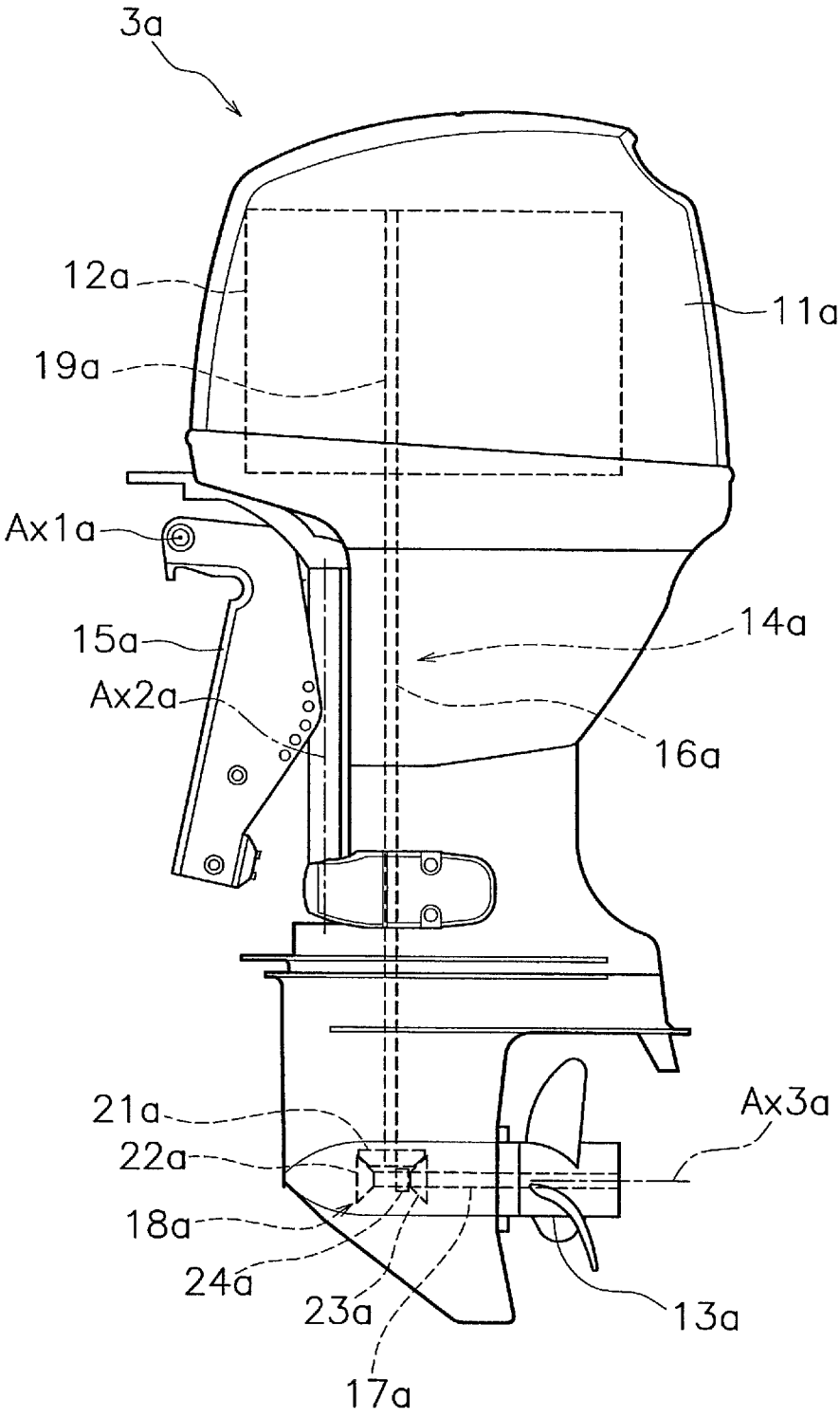
FIG. 2 is a side view of a boat propulsion unit.

FIG. 2 is a side view of the first port unit 3*a*. The structure of the first port unit 3*a* is described below, and is the same as the structures of the second port unit 3*b*, the first starboard unit 3*c*, and the second starboard unit 3*d*. The first port unit 3*a* includes a cover member 11*a*, a first engine 12*a*, a propeller 13*a*, a power transmission mechanism 14*a*, and a bracket 15*a*. The cover member 11*a* accommodates the first engine 12*a* and the power transmission mechanism 14*a*. The first engine 12*a* is disposed in the upper portion of the first port unit 3*a*. The first engine 12*a* is an example of a power source to generate power to propel the boat 1. The propeller 13*a* is disposed in the lower portion of the first port unit 3*a*. The propeller 13*a* is rotatably driven by a drive force from the first engine 12*a*. The power transmission mechanism 14*a* transmits the drive force from the first engine 12*a* to the propeller 13*a*. The power transmission mechanism 14*a* includes a drive shaft 16*a*, a propeller shaft 17*a*, and a shift mechanism 18*a*. The drive shaft 16*a* is disposed along the vertical direction.

The drive shaft 16*a* is coupled to a crank shaft 19*a* of the first engine 12*a*, and transmits power from the first engine 12*a*. The propeller shaft 17*a* is disposed along the longitudinal direction. The propeller shaft 17*a* is coupled to the lower portion of the drive shaft 16*a* via the shift mechanism 18*a*. The propeller shaft 17*a* transmits the drive force from the drive shaft 16*a* to the propeller 13*a*.

The shift mechanism 18*a* switches the rotation direction of the power transmitted from the drive shaft 16*a* to the propeller shaft 17*a*. The shift mechanism 18*a* includes a pinion gear 21*a*, a forward-travel gear 22*a*, a reverse-travel gear 23*a*, and a dog clutch 24*a*. The pinion gear 21*a* is coupled to the drive shaft 16*a*. The pinion gear 21*a* meshes with the forward-travel gear 22*a* and the reverse-travel gear 23*a*. The forward-travel gear 22*a* and the reverse-travel gear 23*a* are arranged so as to allow rotation relative to the propeller shaft 17*a*. The dog clutch 24*a* is movably provided to a forward-travel position, a reverse-travel position, and a neutral position along the axial direction Ax3*a* of the propeller shaft 17*a*. The neutral position is a position between the forward-travel position and the reverse-travel position. The rotation of the drive shaft 16*a* is transmitted to the propeller shaft 17*a* via the forward-travel gear 22*a* when the dog clutch 24*a* is positioned in the forward-travel position. Thus, the propeller 13*a* rotates in the direction to cause the hull 2 to travel forward. The rotation of the drive shaft 16*a* is transmitted to the propeller shaft 17*a* via the reverse-travel gear 23*a* when the dog clutch 24*a* is positioned in the reverse-travel position. Thus, the propeller 13*a* rotates in the direction to cause the hull 2 to travel in reverse. In the case that the dog clutch 24*a* is positioned in the neutral position, the forward-travel gear 22*a* and the reverse-travel gear 23*a* are both capable of rotation relative to the propeller shaft 17*a*. In other words, the rotation from the drive shaft 16*a* is not transmitted to the propeller shaft 17*a*, and the propeller shaft 17*a* is capable of idle rotation.

The bracket 15*a* is a mechanism to mount the first port unit 3*a* onto the hull 2. The first port unit 3*a* is detachably secured to the stern of the hull 2 via the bracket 15*a*. The first port unit 3*a* is rotatably mounted at the center of the tilt axis Ax1*a* of the bracket 15*a*. The tilt axis Ax1*a* extends in the width direction of the hull 2. The first port unit 3*a* is rotatably mounted at the center of the steering axis Ax2*a* of the bracket 15*a*. The first port unit 3*a* rotates about the steering axis Ax2*a* tp vary the steering angle. The steering angle is an angle defined by the direction of the propulsion force in relation to the center line C1 of the hull 2. In other words, the steering angle is the angle defined by the rotation axis Ax3*a* of the propeller 13*a* in relation to the center line C1 of the hull 2. Also, the first port unit 3*a* rotates about the tilt axis Ax1*a* by an actuator (not shown), whereby the trim angle of the first port unit 3*a* is varied. The trim angle corresponds to the mount angle of the propulsion units in relation to the hull 2.

Figure 3:
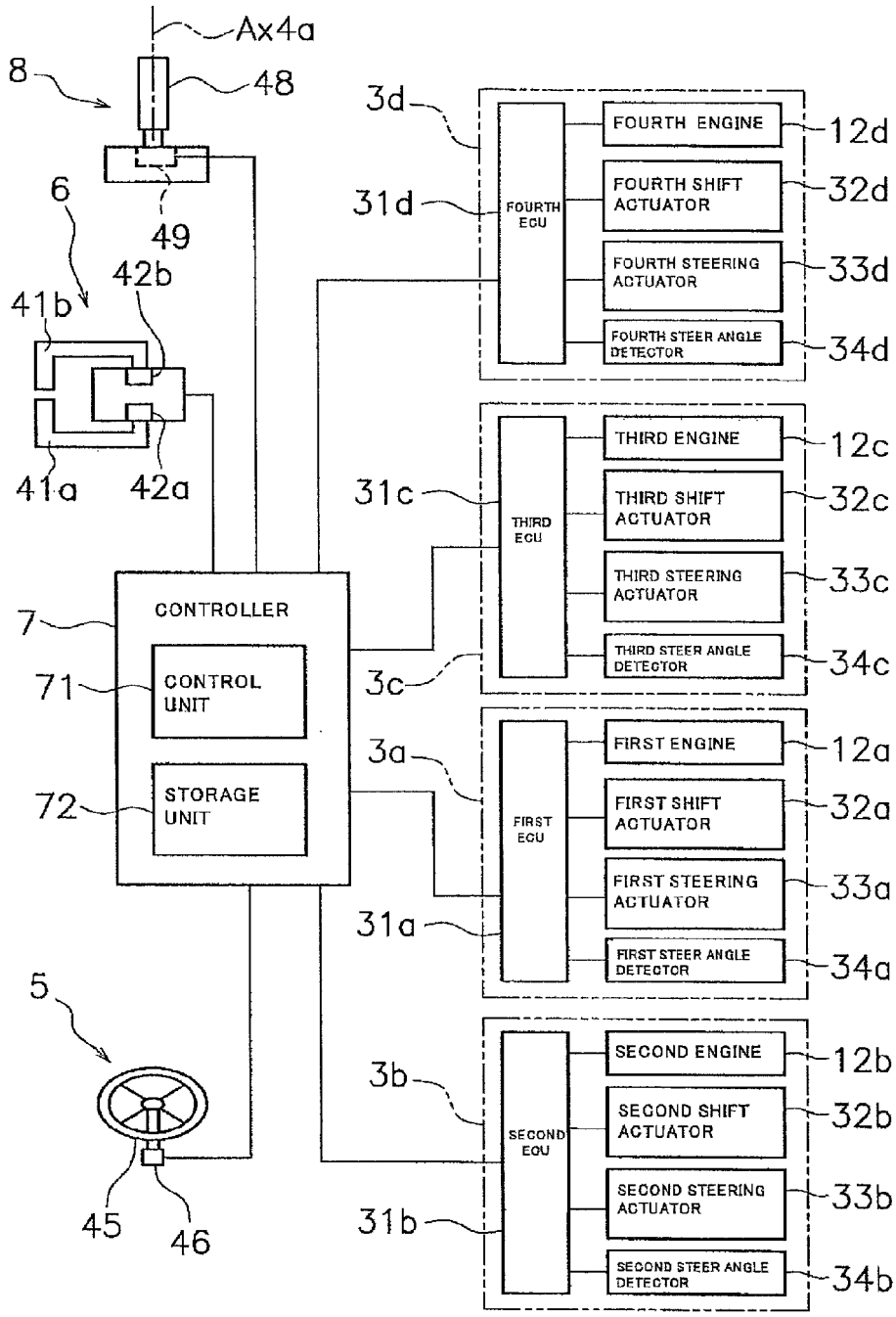
FIG. 3 is a schematic view showing the configuration of the boat propulsion system.

FIG. 3 is a schematic view showing the configuration of the boat propulsion system according to a preferred embodiment of the present invention. The boat propulsion system includes the above-described first port unit 3*a*, the second port unit 3*b*, the first starboard unit 3*c*, the second starboard unit 3*d*, the direction operation device 8, the steering device 5, the remote control device 6, and the controller 7.

The first port unit 3*a* includes a first engine 12*a*, a first ECU 31*a* (electronic control unit), a first shift actuator 32*a*, a first steering actuator 33*a*, and a first steering angle detector 34*a*. The first shift actuator 32*a* switches the position of the above-described dog clutch 24*a* to the forward-travel position, the reverse-travel position, and the neutral position. The first shift actuator 32*a* is, e.g., an electric cylinder. The first steering actuator 33*a* causes the first port unit 3*a* to rotate about the steering axis Ax2*a* of the bracket 15*a*. In this way, the steering angle of the first port unit 3*a* is modified. The first steering actuator 33*a* includes, e.g., a hydraulic cylinder. The first steering angle detector 34*a* detects the actual steering angle of the first port unit 3*a*. The first steering angle detector 34*a* is, e.g., a stroke sensor of the hydraulic cylinder in the case that the first steering actuator 33*a* is a hydraulic cylinder. The first steering angle detector 34*a* sends a detection signal to the first ECU 31*a*.

The first ECU 31*a* stores a program to control the first engine 12*a*. The first ECU 31*a* controls the behavior of the first engine 12*a*, the first shift actuator 32*a*, and the first steering actuator 33*a* on the basis of signals from the steering device 5, the remote control device 6, and the direction operation device 8, detection signals from the first steering angle detector 34*a*, and detection signals from other sensors (not shown) equipped in the first port unit 3*a*. The first ECU 31*a* is connected to the controller 7 via a communication line. Alternatively, the first ECU 31*a* may communicate with the controller 7 wirelessly.

The second port unit 3*b* includes a second engine 12*b*, a second ECU 31*b*, a second shift actuator 32*b*, a second steering actuator 33*b*, and a second steering detector 34*b*. The first starboard unit 3*c* includes a third engine 12*c*, a third ECU 31*c*, a third shift actuator 32*c*, a third steering actuator 33*c*, and a third steering detector 34*c*. The second starboard unit 3*d* includes a fourth engine 12*d*, a fourth ECU 31*d*, a fourth shift actuator 32*d*, a fourth steering actuator 33*d*, and a fourth steering detector 34*d*. The apparatuses of the second port unit 3*b*, first starboard unit 3*c*, and second starboard unit 3*d* have the same functions as the apparatuses of the first port unit 3*a* described above and a detailed description is therefore omitted. The propulsion units 3*a* to 3*d* can be switched between forward and reverse travel directions independently from each other by individually controlling these apparatuses. Also, the propulsion units 3*a* to 3*d* can be steered independently from each other. In FIG. 3, reference numerals having the same numbers are used for apparatuses that correspond to each other in the propulsion units 3*a* to 3*d*.

The remote control device 6 includes a first operation member 41*a*, a first operation position sensor 42*a*, a second operation member 41*b*, and a second operation position sensor 42*b*. The first operation member 41*a* is, e.g., a lever. The first operation member 41*a* can be tilted in the longitudinal direction. The first operation position sensor 42*a* detects the operation position of the first operation member 41*a*. The detection signals of the first operation position sensor 42*a* are transmitted to the controller 7. The dog clutch 24*a* of the first port unit 3*a* is set to the shift position that corresponds to the operation position of the first operation member 41*a* when the operator operates the first operation member 41*a*. Thus, the operator can switch the rotation direction of the propeller 13*a* of the first port unit 3*a* to the forward direction or the reverse direction. Also, the target engine speed of the first port unit 3*a* is set to a value that corresponds to the operation position of the first operation member 41*a*. Thus, the operator can adjust the rotational speed of the propeller 13*a* of the first port unit 3*a*.

The second operation member 41*b* is, e.g., a lever. The second operation member 41*b* is disposed in a line to the left or right of the first operation member 41*a*. The second operation member 41*b* can be tilted in the longitudinal direction. The second operation position sensor 42*b* detects the operation position of the second operation member 41*b*. The detection signals of the second operation position sensor 42*b* are transmitted to the controller 7. The dog clutch of the first starboard unit 3*c* is set to the shift position that corresponds to the operation position of the second operation member 41*b* when the operator operates the second operation member 41*b*. The operator can switch the rotation direction of the propeller of the first starboard unit 3*c* to the forward direction or the reverse direction. Also, the target engine speed of the first starboard unit 3*c* is set to a value that corresponds to the operated position of the second operation member 41*b*. Thus, the operator can adjust the rotational speed of the propeller of the first starboard unit 3*c*.

The switching of the second port unit 3*b* between forward and reverse travel directions, and the target engine speed of the second port unit 3*b*, follow the operation of the first operation member 41*a* in the same manner as the first port unit 3*a*. The switching of the second starboard unit 3*d* between forward and reverse travel directions, and the target engine speed of the second starboard unit 3*d*, follow the operation of the second operation member 41*b* in the same manner as the first starboard unit 3*c*.

The steering device 5 includes a steering member 45 and a steering position sensor 46. The steering member 45 is, e.g., a steering wheel. The steering member 45 is used to set the target steering angles of the propulsion units 3*a* to 3*d*. The steering position sensor 46 detects the operation amount, i.e., the operation angle of the steering member 45. The detection signals of the steering position sensor 46 are sent to the controller 7. The first to fourth steering actuators 33*a* to 33*d* are driven when the operator operates the steering member 45. Thus, the operator can adjust the travel direction of the boat 1. The controller 7 can independently control the first to fourth steering actuators 33*a* to 33*d*.

The direction operation device 8 is, e.g., a joystick device, and includes a direction command member 48 and an operation position sensor 49. The direction command member 48 preferably has a rod shape, and is disposed so as to allow tilting at least forward, reverse, left, and right. Therefore, the direction command member 48 is capable of making operational commands in at least the forward, reverse, left, and right directions. The operation position sensor 49 detects the operation position of the direction command member 48. The direction operation device 8 may output commands in four or more directions, or may output commands in all directions. The direction command member 48 outputs operational commands in a rotation direction. The direction command member 48 is disposed so as to allow rotation about an axial line Ax4*a* of the direction command member 48. The detection signals of the operation position sensor 49 are sent to the controller 7. When the operator tiltably operates the direction command member 48, the propulsion units 3*a* to 3*d* are controlled so that the hull 2 translates in the direction that corresponds to the tilt direction of the direction command member 48. When the operator rotatably operates the direction command member 48, the propulsion units 3*a* to 3*d* are controlled so that the hull 2 rotates (pivots) in the direction that corresponds to the direction of rotation of the direction command member 48. The movement control of the propulsion units 3*a* to 3*d* made by the operation of the direction operation device 8 is described below.

The controller 7 includes a control unit 71 and a storage unit 72. The control unit 71 includes a CPU or other computation device. The storage unit 72 includes, e.g., a RAM, ROM, or other semiconductor storage unit; a hard disk drive; or a flash memory or other device. The storage unit 72 stores programs and data to control the propulsion units 3*a* to 3*d*. The controller 7 sends command signals to the first to fourth ECUs 31*a* to 31*d* on the basis of signals from the steering device 5, the remote control device 6, and the direction operation device 8. Thus, the propulsion units 3*a* to 3*d* are controlled. Control of the propulsion units 3*a* to 3*d* by operation of the direction operation device 8 is described in detail below.

The control unit 71 individually controls the target steering angle, the target propulsion force, and the propulsion direction of the four propulsion units 3*a* to 3*d* for forward and reverse travel in accordance with operational commands from the direction operation device 8. The target propulsion force of the propulsion units 3*a* to 3*d* corresponds to the target engine speed. Therefore, the control unit 71 controls the target engine speed to control the target propulsion force of the propulsion units 3*a* to 3*d*. Control of the target propulsion force of the propulsion units 3*a* to 3*d* is not limited to the target engine speed, and it is also possible to perform control using the rotational speed of the propellers, the opening degree of the engine throttle, or other factors.

The control unit 71 sends command signals indicating the target propulsion force and the propulsion direction of the propulsion units 3*a* to 3*d* to the first to fourth ECUs 31*a* to 31*d* in accordance with operational commands from the direction operation device 8. Also, the control unit 71 sends command signals indicating the target steering angle of the propulsion units 3*a* to 3*d* to the first to fourth steering actuators 33*a* to 33*d* in accordance with operational commands from the direction operation device 8. Thus, the propulsion force and steering angle of each of the propulsion units 3*a* to 3*d* are controlled so that the hull 2 translates in the direction that corresponds to the operation direction of the direction operation device 8.

Figure 4:
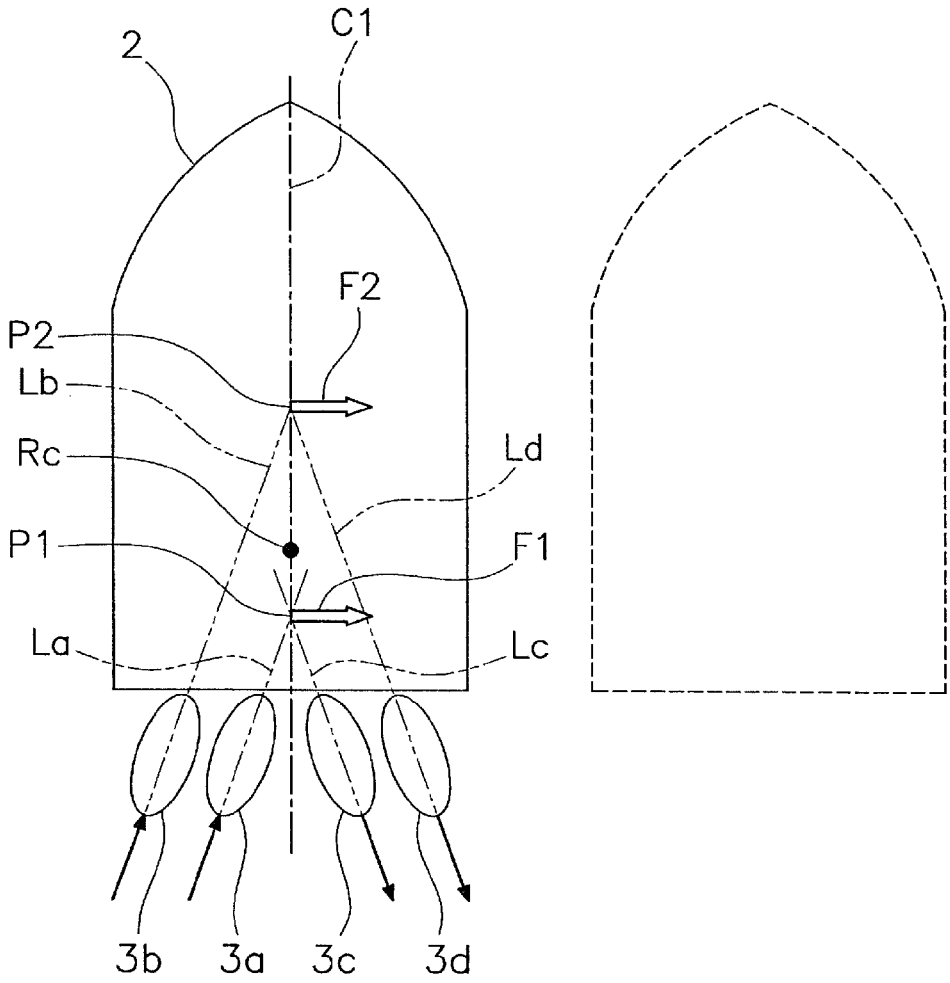
FIG. 4 is a schematic view showing a first movement control according to a preferred embodiment of the present invention.

FIG. 4 is a schematic view showing the behavior of the hull 2 produced by a first movement control of the present preferred embodiment. When the operational command of the direction operation device 8 is in the rightward direction, the control unit 71 controls the propulsion force, the steering angle, and the propulsion direction of each of the propulsion units 3*a* to 3*d* so that the moment of the force by which a first resultant force F1 rotates the hull 2 and the moment of the force by which a second resultant force F2 rotates the hull 2 cancel each other, and the hull 2 translates rightward. The first resultant force F1 is the resultant force of the propulsion forces generated by the first port unit 3*a* and the first starboard unit 3*c*. The second resultant force F2 is the resultant force of the propulsion forces generated by the second port unit 3*b* and the second starboard unit 3*d*.

Specifically, the control unit 71 steers the second port unit 3*b* and the second starboard unit 3*d* in the toe-in direction, and steers the first port unit 3*a* and the first starboard unit 3*c* in the toe-in direction, as shown in FIG. 4. The control unit 71 sets the propulsion direction of the first port unit 3*a* and the second port unit 3*b* to be forward, and sets the propulsion direction of the first starboard unit 3*c* and the second starboard unit 3*d* to be rearward. At this time, a point of action P1 of the first resultant force F1 is positioned behind a point of action P2 of the second resultant force F2. A line of action Lb of the propulsion force generated by the second port unit 3*b* and a line of action Ld of the propulsion force generated by the second starboard unit 3*d* pass in front of a resistance center RC of the hull 2. A line of action La of the propulsion force generated by the first port unit 3*a* and a line of action Lc of the propulsion force generated by the first starboard unit 3*c* pass behind the resistance center RC of the hull 2. Therefore, the point of action P1 of the first resultant force F1 is positioned behind the resistance center RC of the hull 2. The point of action P2 of the second resultant force F2 is positioned in front of the resistance center RC of the hull 2. The resistance center RC is the action position of the resultant force of the propulsion force to cancel the thrust force of the propeller and cause the hull 2 to move directly sideward. The point of action P1 of the first resultant force F1 and the point of action P2 of the second resultant force F2 are positioned on the center line C1 of the hull 2. The first resultant force F1 acts rightward at the point of action P1 thereof. The second resultant force F2 acts rightward at the point of action P2 thereof. Also, the propulsion force and the steering angle of each of the propulsion units 3*a* to 3*d* are set so that the moment of the force by which the first resultant force F1 rotates the hull 2 and the moment of the force by which the second resultant force F2 rotates the hull 2 cancel each other.

When the propulsion units 3*a* to 3*d* are controlled in the manner described above, the hull 2 translates rightward. When the operational command of the direction operation device 8 is in the leftward direction, the control unit 71 sets the propulsion direction of the first port unit 3*a* and second port unit 3*b* to be rearward, and sets the propulsion direction of the first starboard unit 3*c* and the second starboard unit 3*d* to be forward. The other control details of the propulsion units 3*a* to 3*d* are the same as when the operational command of the direction operation device 8 is in the rightward direction. Thus, the hull 2 translates leftward.

Figure 5:
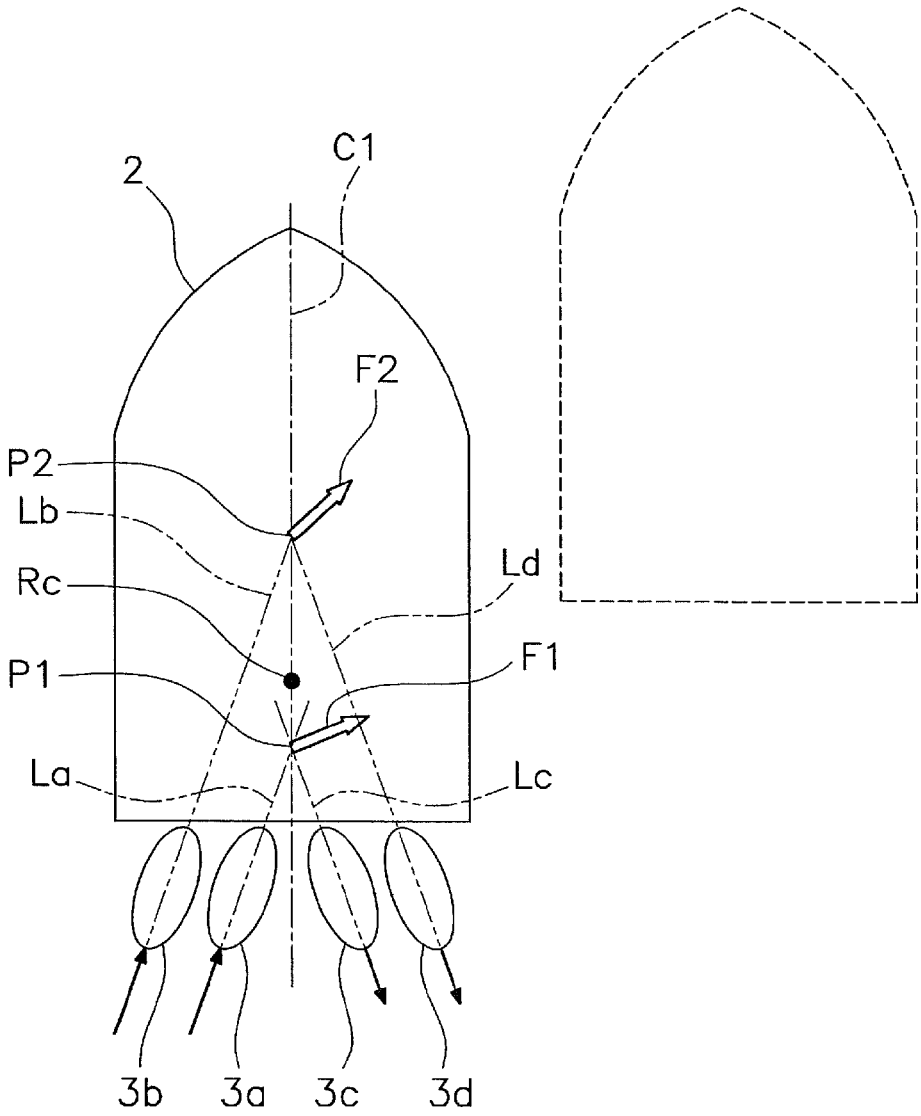
FIG. 5 is a schematic view showing a second movement control according to a preferred embodiment of the present invention.

FIG. 5 is a schematic view showing the behavior of the hull 2 produced by a second movement control of the present preferred embodiment. When the operational command from the direction operation device 8 is in the right diagonally forward direction, the control unit 71 controls the propulsion force, the steering angle, and the propulsion direction of each of the propulsion units 3*a* to 3*d* so that the moment of the force by which the first resultant force F1 causes the hull 2 to rotate and the moment of the force by which the second resultant force F2 causes the hull 2 to rotate, cancel each other and the hull 2 translates rightward and diagonally forward.

Specifically, the control unit 71 reduces the propulsion force of the first starboard unit 3*c* to less than the propulsion force of the first port unit 3*a*, and reduces the propulsion force of the second starboard unit 3*d* to less than the propulsion force of the second port unit 3*b*, as shown in FIG. 5. The first resultant force F1 acts at the point of action P1 in the right diagonal forward direction. The second resultant force F2 acts at the point of action P2 thereof in the right diagonal forward direction. The steering angle and the propulsion force of each of the propulsion units 3*a* to 3*d* are set so that the resistance center RC is positioned on the line of action of the resultant forces of the first resultant force F1 and the second resultant force F2. Other control details of the propulsion units 3*a* to 3*d* are the same as those of the first movement control when the operational command of the direction operation device 8 is in the rightward direction.

When the propulsion units 3*a* to 3*d* are controlled in the manner described above, the hull 2 translates in the right diagonal forward direction. When the operational command of the direction operation device 8 is in the left diagonal rearward direction, the control unit 71 sets the propulsion direction of the first port unit 3*a* and the second port unit 3*b* to be rearward, and sets the propulsion direction of the first starboard unit 3*c* and the second starboard unit 3*d* to be forward. The first resultant force F1 acts at the point of action P1 thereof in the left diagonal rearward direction. The second resultant force F2 acts at the point of action P2 thereof in the left diagonal rearward direction. Other control details of the propulsion units 3*a* to 3*d* are the same as those when the operational command of the direction operation device 8 is in the right diagonal forward direction. Thus, the hull 2 translates in the left diagonal rearward direction.

When the operational command of the direction operation device 8 is in the right diagonal rearward direction, the control unit 71 reduces the propulsion force of the first port unit 3*a* to less than the propulsion force of the first starboard unit 3*c*, and reduces the propulsion force of the second port unit 3*b* to less than the propulsion force of the second starboard unit 3*d*. The first resultant force F1 acts at the point of action P1 thereof in the right diagonal rearward direction. The second resultant force F2 acts at the point of action P2 thereof in the right diagonal rearward direction. Other control details of the propulsion units 3*a* to 3*d* are the same as those when the operational command of the direction operation device 8 is in the right diagonal forward direction. Thus, the hull 2 translates in the right diagonal rearward direction.

When the operational command of the direction operation device 8 is in the left diagonal forward direction, the control unit 71 sets the propulsion direction of the first port unit 3*a* and the second port unit 3*b* to be rearward, and sets the propulsion direction of the first starboard unit 3*c* and the second starboard unit 3*d* to be forward. The control unit 71 reduces the propulsion force of the first port unit 3*a* to less than the propulsion force of the first starboard unit 3*c*, and reduces the propulsion force of the second port unit 3*b* to less than the propulsion force of the second starboard unit 3*d*. The first resultant force F1 acts at the point of action P1 thereof in the left diagonal forward direction. The second resultant force F2 acts at the point of action P2 thereof in the left diagonal forward direction. Other control details of the propulsion units 3*a* to 3*d* are the same as those when the operational command of the direction operation device 8 is in the right diagonal forward direction. Thus, the hull 2 translates in the left diagonal forward direction.

Figure 6:
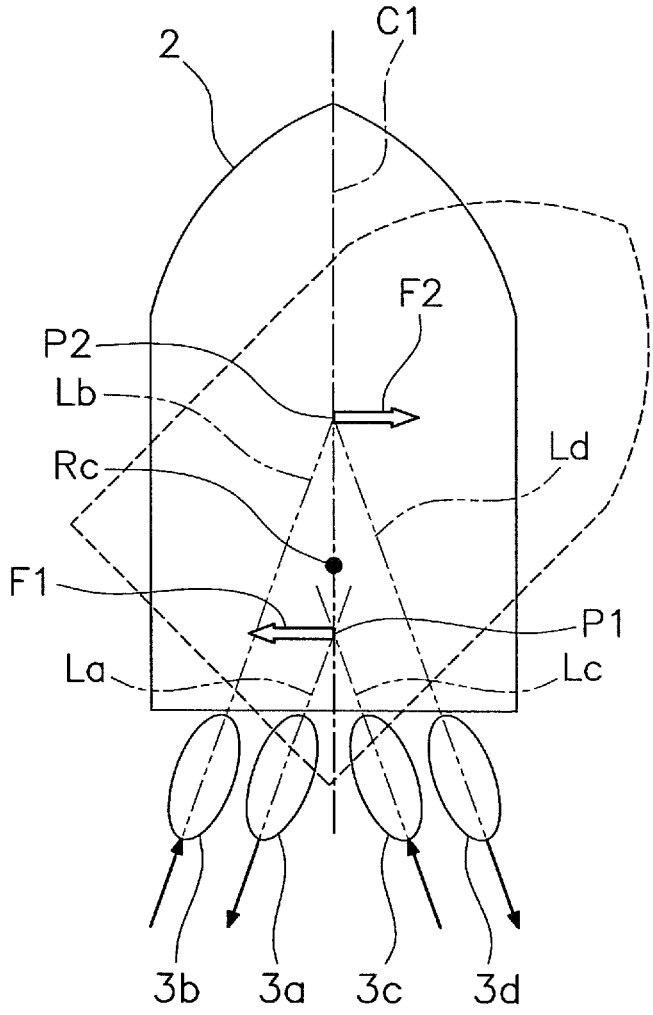
FIG. 6 is a schematic view showing a third movement control according to a preferred embodiment of the present invention.

FIG. 6 is a schematic view showing the behavior of the hull 2 produced by a third movement control of the present preferred embodiment. When the operational command of the direction operation device 8 is right rotation, the control unit 71 controls the propulsion force, the steering angle, and the propulsion direction of each of the propulsion units 3*a* to 3*d* so that the moment of the force by which the first resultant force F1 rotates the hull 2 and the moment of the force by which the second resultant force F2 rotates the hull 2 cause the hull 2 to rotate to the right.

Specifically, the control unit 71 steers the second port unit 3*b* and the second starboard unit 3*d* in the toe-in direction, and steers the first port unit 3*a* and the first starboard unit 3*c* in the toe-in direction, as shown in FIG. 6. Also, the control unit 71 sets the propulsion direction of the first starboard unit 3*c* and the second port unit 3*b* in the forward direction, and sets the propulsion direction of the first port unit 3*a* and the second starboard unit 3*d* in the rearward direction. At this point, the point of action P2 of the second resultant force F2 is positioned in front of the resistance center RC of the hull 2 and on the center line C1 of the hull 2. The point of action P1 of the first resultant force F1 is positioned behind the resistance center RC of the hull 2 and on the center line C1 of the hull 2. The first resultant force F1 acts leftward at the point of action P1 thereof. The second resultant force F2 acts rightward at the point of action P2 thereof. Therefore, the first resultant force F1 and the second resultant force F2 act together in the direction that rotates the hull 2 to the right.

When the propulsion units 3*a* to 3*d* are controlled in the manner described above, the hull 2 is rotated to the right. When the operational command of the direction operation device 8 is left rotation, the control unit 71 sets the propulsion direction of the first starboard unit 3*c* and the second port unit 3*b* to be rearward, and sets the propulsion direction of the first port unit 3*a* and the second starboard unit 3*d* to be forward. The first resultant force F1 acts rightward at the point of action P1 thereof. The second resultant force F2 acts leftward at the point of action P2 thereof. The other control details of the propulsion units 3*a* to 3*d* are the same as when the operational command of the direction operation device 8 is right rotation. Thus, the hull 2 rotates to the left.

Figure 7:
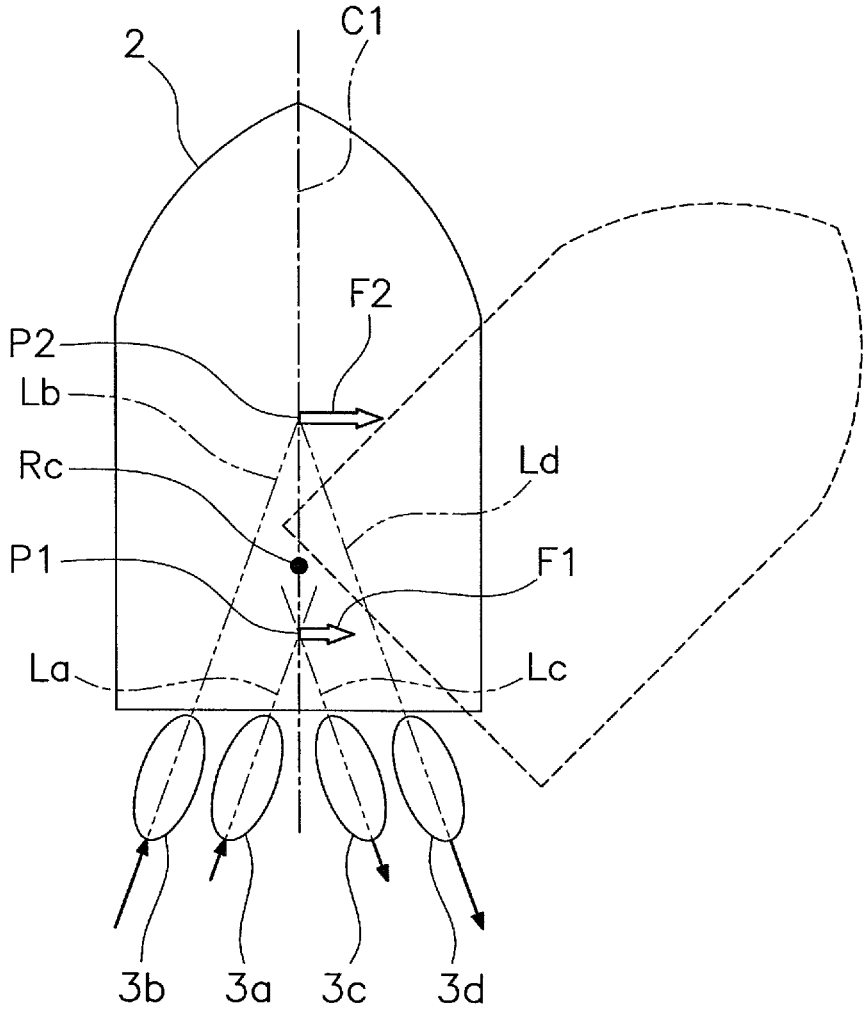
FIG. 7 is a schematic view showing a fourth movement control according to a preferred embodiment of the present invention.

FIG. 7 is a schematic view showing the behavior of the hull 2 produced by a fourth movement control of the present preferred embodiment. When the operational command from the direction operation device 8 is rightward and right rotation, the control unit 71 controls the propulsion force, the steering angle, and the propulsion direction of each of the propulsion units 3*a* to 3*d* so that the hull 2 translates in the rightward direction while rotating to the right.

Specifically, the control unit 71 steers the first port unit 3*a* and the first starboard unit 3*c* in the toe-in direction, and steers the second port unit 3*b* and the second starboard unit 3*d* in the toe-in direction, as shown in FIG. 7. The control unit 71 sets the propulsion direction of the first port unit 3*a* and the second port unit 3*b* to be forward, and sets the propulsion direction of the first starboard unit 3*c* and the second starboard unit 3*d* to be rearward. Also, the control unit 71 reduces the propulsion force of the first port unit 3*a* to less than the second port unit 3*b*, and reduces the propulsion force of the first starboard unit 3*c* to less than the second starboard unit 3*d*. At this point, the point of action P1 of the first resultant force F1 is positioned behind the resistance center RC of the hull 2, and the point of action P2 of the second resultant force F2 is positioned in front of the resistance center RC of the hull 2. The point of action P1 of the first resultant force F1 and the point of action P2 of the second resultant force F2 are positioned on the center line C1 extending in the longitudinal direction of the hull 2.

The first resultant force F1 acts rightward at the point of action P1 thereof. The second resultant force F2 acts rightward at the point of action P2 thereof. The moment of the force by which the second resultant force F2 causes the hull 2 to rotate is greater than the moment of the force by which the first resultant force F1 causes the hull 2 to rotate. Also, the steering angle of the propulsion units 3*a* to 3*d* is modified in accordance with the rotation of the hull 2 so that translational movement of the hull 2 to the right is maintained after the start of rotation of the hull 2.

When the propulsion units 3*a* to 3*d* are controlled in the manner described above, the hull 2 translates rightward while rotating to the right. When the operational command of the direction operation device 8 is in the left direction and left rotation, the control unit 71 sets the propulsion direction of the first port unit 3*a* and the second port unit 3*b* to be rearward, and sets the propulsion direction of the first starboard unit 3*c* and the second starboard unit 3*d* to be forward. The first resultant force F1 acts leftward at the point of action P1 thereof. The second resultant force F2 acts leftward at the point of action P2 thereof. The other control details of the propulsion units 3*a* to 3*d* are the same as when the operational command of the direction operation device 8 is in the right direction and right rotation. Thus, the hull 2 translates to the left while rotating to the left.

Figure 8:
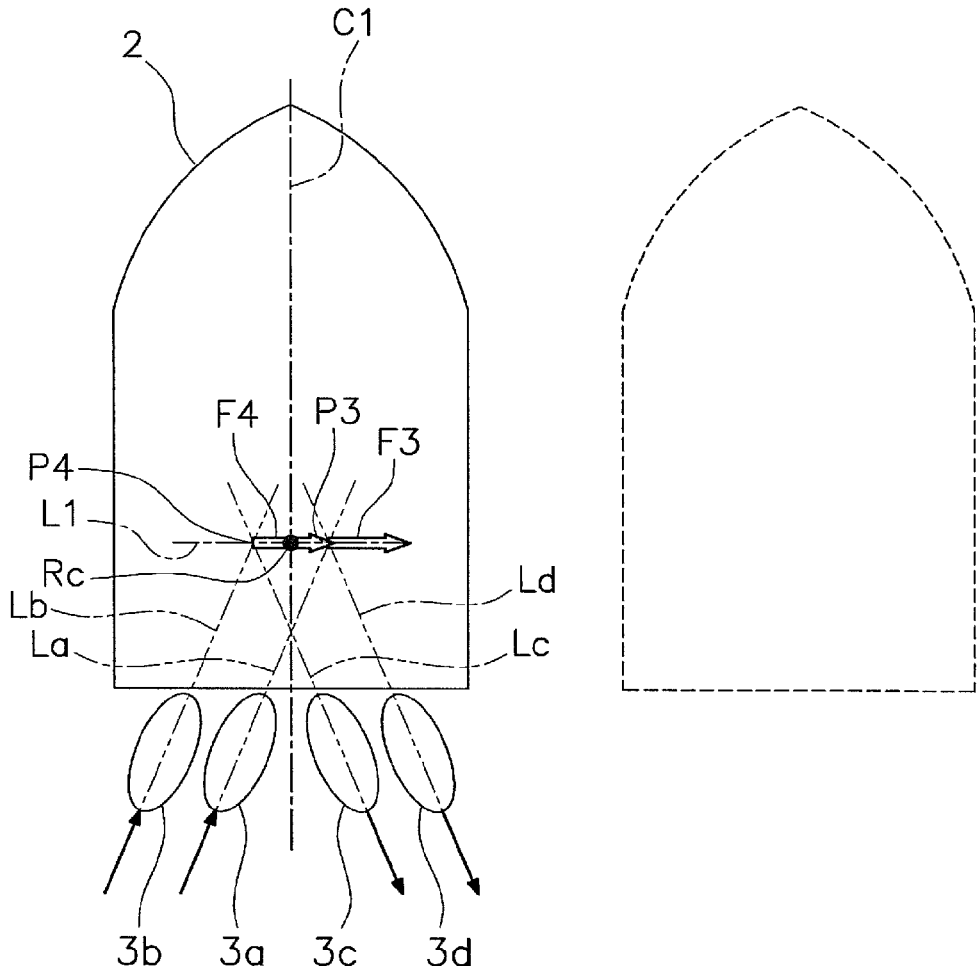
FIG. 8 is a schematic view showing movement control according to a first modification of a preferred embodiment of the present invention.

FIG. 8 is a schematic view showing the behavior of the hull 2 produced by movement control according to a first modification of a preferred embodiment of the present invention. When the operational command from the direction operation device 8 is in the rightward direction, the control unit 71 controls the propulsion force, the steering angle, and the propulsion direction of each of the propulsion units 3*a* to 3*d* so that a point of action P3 of a third resultant force F3 and a point of action P4 of a fourth resultant force F4 are positioned on a virtual line L1. The third resultant force F3 is the resultant force of the propulsion forces generated by the first port unit 3*a* and the second starboard unit 3*d*. The fourth resultant force F4 is the resultant force of the propulsion forces generated by the first starboard unit 3*c* and the second port unit 3*b*. The virtual line L1 passes through the resistance center RC of the hull 2 and extends in the lateral direction of the hull 2.

Specifically, the control unit 71 steers the second port unit 3*b* and the second starboard unit 3*d* in the toe-in direction, and steers the first port unit 3*a* and first starboard unit 3*c* in the toe-in direction. The control unit 71 sets the propulsion direction of the first port unit 3*a* and the second port unit 3*b* to be forward, and sets the propulsion direction of the first starboard unit 3*c* and the second starboard unit 3*d* to be rearward. The third resultant force F3 acts rightward at the point of action P3 thereof. The fourth resultant force F4 acts rightward at the point of action P4 thereof. Although not shown in the drawings, the point of action P1 of the first resultant force F1 is positioned behind the point of action P2 of the second resultant force F2 in this case as well, in the same manner as with the first movement control.

When the propulsion units 3*a* to 3*d* are controlled in the manner described above, the hull 2 translates rightward. When the operational command of the direction operation device 8 is in the left direction, the control unit 71 sets the propulsion direction of the first port unit 3*a* and the second port unit 3*b* to be rearward, and sets the propulsion direction of the first starboard unit 3*c* and the second starboard unit 3*d* to be forward. The third resultant force F3 acts leftward at the point of action P3 thereof. The fourth resultant force F4 acts leftward at the point of action P4 thereof. The other control details of the propulsion units 3*a* to 3*d* are the same as when the operational command of the direction operation device 8 is in the rightward direction. Thus, the hull 2 translates leftward.

Figure 9:
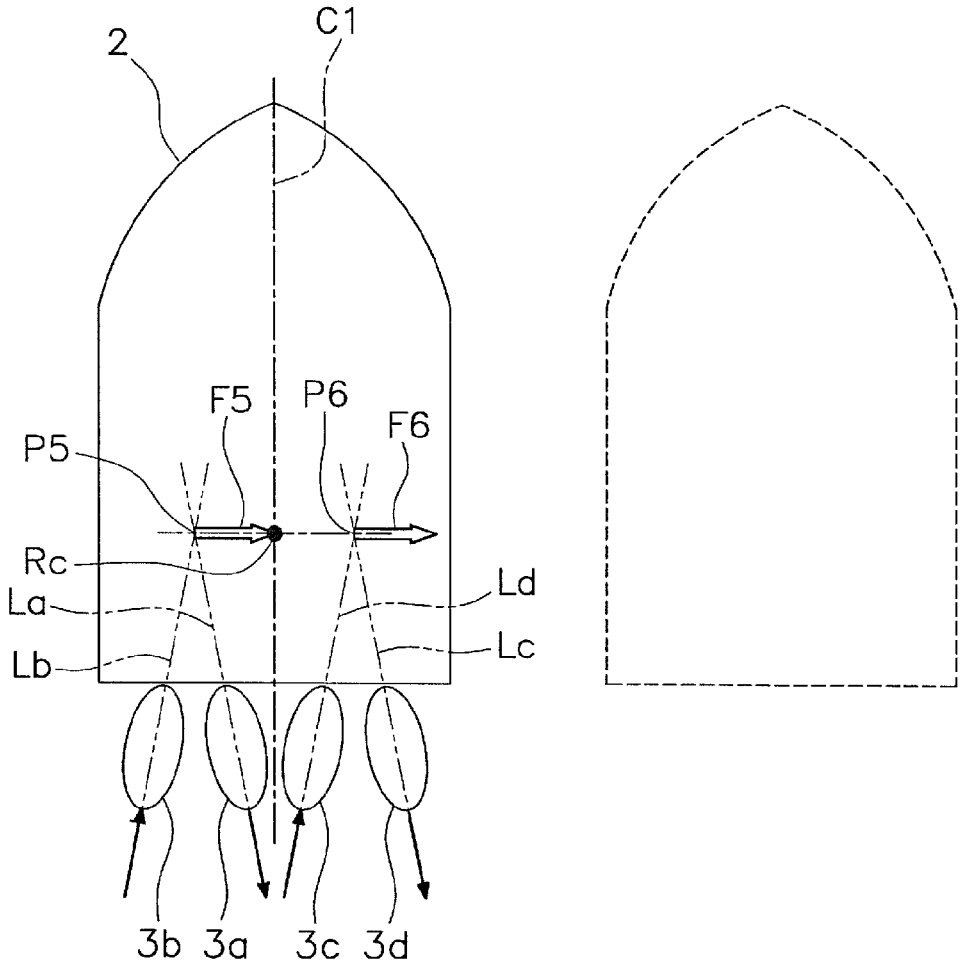
FIG. 9 is a schematic view showing movement control according to a second modification of a preferred embodiment of the present invention.
Figure 10:
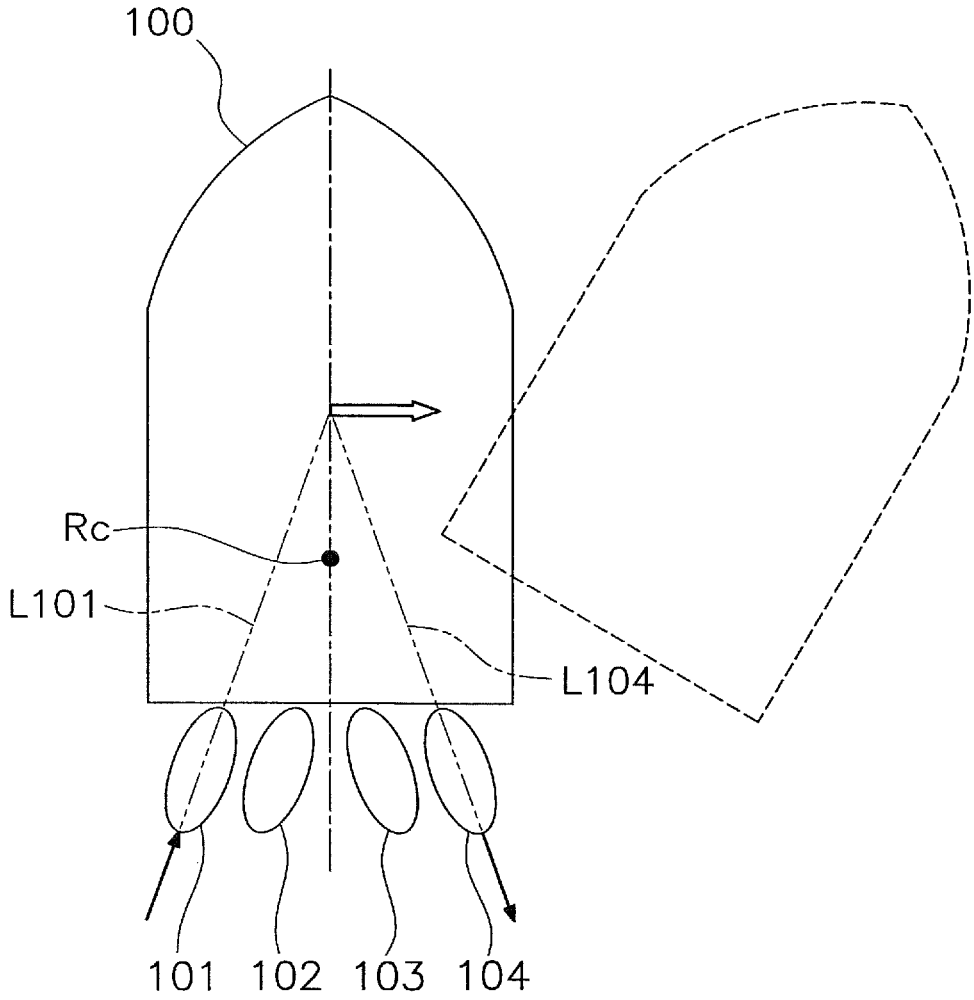
FIG. 10 is a schematic view showing movement control according to a comparative example.

FIG. 9 is a schematic view showing the behavior of the hull 2 produced by movement control according to a second modification of the present invention. When the operational command from the direction operation device 8 is in the rightward direction, the control unit 71 steers the second port unit 3*b* and the second starboard unit 3*d* in the toe-in direction, and steers the first port unit 3*a* and the first starboard unit 3*c* in the toe-out direction. Also, the control unit 71 sets the propulsion direction of the second port unit 3*b* and the first starboard unit 3*c* to be forward, and sets the propulsion direction of the first port unit 3*a* and the second starboard unit 3*d* to be rearward. At this time, a point of action P5 of a fifth resultant force F5 and a point of action P6 of a sixth resultant force F6 are positioned on the virtual line L1. The fifth resultant force F5 is the resultant force of the propulsion forces generated by the first port unit 3*a* and the second port unit 3*b*. The sixth resultant force F6 is the resultant force of the propulsion forces generated by the first starboard unit 3*c* and the second starboard unit 3*d*. The fifth resultant force F5 acts rightward at the point of action P5 thereof. The sixth resultant force F6 acts rightward at the point of action P6 thereof. Although not shown in the drawings, the point of action P1 of the first resultant force F1 is positioned behind the point of action P2 of the second resultant force F2 in this case as well, in the same manner as with the first movement control.

When the propulsion units 3*a* to 3*d* are controlled in the manner described above, the hull 2 translates rightward. When the operational command of the direction operation device 8 is in the left direction, the control unit 71 sets the propulsion direction of the first port unit 3*a* and the second starboard unit 3*d* to be forward, and sets the propulsion direction of the second port unit 3*b* and the first starboard unit 3*c* to be rearward. The fifth resultant force F5 acts leftward at the point of action P5 thereof. The sixth resultant force F6 acts leftward at the point of action P6 thereof. The other control details of the propulsion units 3*a* to 3*d* are the same as when the operational command of the direction operation device 8 is in the rightward direction. Thus, the hull 2 translates leftward.

Preferred embodiments of the present invention have been described above, but the present invention is not limited by the preferred embodiments described above, and it is also possible to make various modifications that do not depart from the scope of the present invention.

The number of boat propulsion units is not limited to four, and may be five or more. The boat propulsion units are not limited to outboard engines, and may be stern drives or other types of propulsion units.

In the preferred embodiments described above, the controller 7 is preferably independent from other devices, but the controller 7 may also be equipped in another device. For example, the controller 7 may be equipped in the steering device 5.

The direction operation device 8 is not limited to a joystick, and may be any device capable of an operational command in at least the four directions of forward, rearward, left, and right. For example, the direction operation device 8 may be a trackball. Alternatively, the direction operation device 8 may be a touch panel-type display device.

In the preferred embodiments described above, hydraulic cylinders are preferably used as an example of the first to fourth steering actuators 33*a* to 33*d*, but other actuators are also possible. For example, the first to fourth steering actuators 33*a* to 33*d* may be actuators including electric motors. The first to fourth shift actuators 32*a* to 32*d* are not limited to electric cylinders, and may also be other actuators. For example, the first to fourth shift actuators 32*a* to 32*d* may be actuators including hydraulic cylinders or electric motors.

In accordance with the preferred embodiments of the present invention, it is possible to provide a boat propulsion system and a method for controlling a boat propulsion system in which a boat can be effectively made to move laterally on the basis of an operational command provided by a direction operation device in a boat equipped with at least four propulsion units.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A boat propulsion system comprising:

a plurality of boat propulsion units arranged to switch between forward and reverse propulsion directions independently from each other and to be steered independently from each other, the plurality of boat propulsion units including a first port-side propulsion unit disposed to the left of a center line extending in a longitudinal direction of a hull, a second port-side propulsion unit disposed to the left of the first port-side propulsion unit, a first starboard-side propulsion unit disposed to the right of the center line, and a second starboard-side propulsion unit disposed to the right of the first starboard-side propulsion unit;

an operation device arranged to command travel at least in the directions of forward, reverse, left, and right; and a control unit programmed to individually control the forward and reverse propulsion directions, a propulsion force, and a steering angle of each of the plurality of boat propulsion units such that when the control unit receives an operational command from the operation device for travel in a lateral direction of the hull, a point of action of a first resultant force, which is a resultant force of propulsion forces generated by the first port-side propulsion unit and the first starboard-side propulsion unit, is positioned behind, in the longitudinal direction of the hull, a point of action of a second resultant force, which is a resultant force of propulsion forces generated by the second port-side propulsion unit and the second starboard-side propulsion unit.

2. The boat propulsion system according to claim 1, wherein, when the control unit receives an operational command from the operation device for travel in the lateral direction, the control unit is programmed to control the propulsion force, the steering angle, and the propulsion direction of each of the propulsion forces generated by each of the plurality of propulsion units so that a moment of force by which the first resultant force rotates the hull and a moment of force by which the second resultant force rotates the hull cancel each other such that the hull translates in the lateral direction.

3. The boat propulsion system according to claim 1, wherein, when the control unit receives an operational command from the operation device for travel in the lateral direction, a line of action of the propulsion force generated by the second port-side propulsion unit and a line of action of the propulsion force generated by the second starboard-side propulsion unit pass in front, in the longitudinal direction of the hull, of a resistance center of the hull.

4. The boat propulsion system according to claim 1, wherein, when the control unit receives an operational command from the operation device for travel in the lateral direction, the point of action of the first resultant force is positioned behind a resistance center of the hull, and the point of action of the second resultant force is positioned in front, in the longitudinal direction of the hull, of the resistance center of the hull.

5. The boat propulsion system according to claim 1, wherein, when the control unit receives an operational command from the operation device for travel in the lateral direction, the point of action of the first resultant force and the point of action of the second resultant force are positioned on the center line.

6. The boat propulsion system according to claim 1, wherein, when the control unit receives an operational command from the operation device for travel in the lateral direction, the control unit is programmed to steer the second port-side propulsion unit and the second starboard-side propulsion unit in a toe-in direction, to steer the first port-side propulsion unit and the first starboard-side propulsion unit in the toe-in direction, to set the propulsion direction of each of the first port-side propulsion unit and the second port-side propulsion unit to be one of forward and reverse, and to set the propulsion direction of each of the first starboard-side propulsion unit and the second starboard-side propulsion unit to be the other of forward and reverse.

7. The boat propulsion system according to claim 6, wherein, when the control unit receives an operational command from the operation device for travel in the lateral direction, the point of action of the propulsion force generated by the first port-side propulsion unit and the second starboard-side propulsion unit, and the point of action of the propulsion force generated by the first starboard-side propulsion unit and the second port-side propulsion unit are positioned on an axis that passes through a resistance center of the hull and extends in the lateral direction of the hull.

8. The boat propulsion system according to claim 6, wherein, when the control unit receives an operational command from the operation device for travel in the lateral direction, the point of action of the first resultant force is positioned behind a resistance center of the hull, and the point of action of the second resultant force is positioned in front, in the longitudinal direction of the hull, of the resistance center of the hull.

9. The boat propulsion system according to claim 1, wherein, when the control unit receives an operational command from the operation device for travel in the lateral direction, the control unit is programmed to steer each of the second port-side propulsion unit and the second starboard-side propulsion unit in a toe-in direction, to steer each of the first port-side propulsion unit and the first starboard-side propulsion unit in the toe-out direction, to set the propulsion direction of each of the second port-side propulsion unit and the first starboard-side propulsion unit to be one of forward and reverse, and to set the propulsion direction of each of the first port-side propulsion unit and the second starboard-side propulsion unit to be the other of forward and reverse.

10. The boat propulsion system according to claim 9, wherein, when the control unit receives an operational command from the operation device for travel in the lateral direction, the point of action of the propulsion force generated by the first port-side propulsion unit and the second port-side propulsion unit, and the point of action of the propulsion force generated by the first starboard-side propulsion unit and the second starboard-side propulsion unit are positioned on an axis that passes through a resistance center of the hull and extends in the lateral direction of the hull.

11. The boat propulsion system according to claim 1, wherein, when an operational command from the operation device includes travel in the longitudinal direction, the point of action of the second resultant force is positioned in front, in the longitudinal direction of the hull, of a resistance center of the hull and on the center line, and the point of action of the first resultant force is positioned behind the resistance center of the hull and on the center line.

12. The boat propulsion system according to claim 1, wherein the operation device includes a rotational operation, and when an operational command from the operation device includes rotational operation, the point of action of the second resultant force is positioned in front, in the longitudinal direction of the hull, of a resistance center of the hull and on the center line, and the point of action of the first resultant force is positioned behind the resistance center of the hull and on the center line.

13. A method for controlling a boat propulsion system including a plurality of boat propulsion units that can switch between forward and reverse travel directions independently from each other and that can be steered independently from each other, the plurality of boat propulsion units including a first port-side propulsion unit disposed to the left of a center line extending in a longitudinal direction of a hull, a second port-side propulsion unit disposed to the left of the first port-side propulsion unit, a first starboard-side propulsion unit disposed to the right of the center line, and a second starboard-side propulsion unit disposed to the right of the first starboard-side propulsion unit, the method for controlling the boat propulsion system comprising:

receiving an operational command from an operation device that outputs operational commands at least in the directions of forward, reverse, left, and right; and individually controlling the forward and reverse propulsion directions, a propulsion force, and a steering angle of each of the plurality of boat propulsion units so that, when an operational command from the operation device for travel in a lateral direction of the hull is received, a point of action of a first resultant force, which is a resultant force of propulsion forces generated by the first port-side propulsion unit and the first starboard-side propulsion unit, is positioned behind, in a longitudinal direction of a hull, a point of action of a second resultant force, which is a resultant force of propulsion forces generated by the second port-side propulsion unit and the second starboard-side propulsion unit.

* * * * *